US009362693B2

(12) United States Patent
Martin et al.

(10) Patent No.: US 9,362,693 B2
(45) Date of Patent: Jun. 7, 2016

(54) HEADER ASSEMBLY HAVING POWER AND SIGNAL CARTRIDGES

(71) Applicant: TYCO ELECTRONICS CORPORATION, Berwyn, PA (US)

(72) Inventors: Galen M. Martin, Camp Hill, PA (US); Matthew Bryan Hitchcock, Harrisburg, PA (US); James O. Crawford, Greensboro, NC (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 26 days.

(21) Appl. No.: 14/154,366

(22) Filed: Jan. 14, 2014

(65) Prior Publication Data

US 2015/0200508 A1 Jul. 16, 2015

(51) Int. Cl.

| | |
|---|---|
| ***H01R 13/514*** | (2006.01) |
| ***H01R 24/66*** | (2011.01) |
| ***H01R 13/42*** | (2006.01) |
| ***H01R 12/70*** | (2011.01) |
| ***H01R 12/72*** | (2011.01) |
| ***H01R 13/518*** | (2006.01) |
| *H01R 13/506* | (2006.01) |

(52) U.S. Cl.

CPC ..... *H01R 24/66* (2013.01); *H01R 12/7088* (2013.01); *H01R 12/724* (2013.01); *H01R 13/42* (2013.01); *H01R 13/514* (2013.01); *H01R 13/518* (2013.01); *H01R 13/506* (2013.01)

(58) Field of Classification Search

CPC ..... H01R 13/502; H01R 13/514
USPC ..... 439/695, 638, 544, 701, 79, 108, 947, 439/502, 65, 594, 717
See application file for complete search history.

(56) References Cited

U.S. PATENT DOCUMENTS

| | | | | |
|---|---|---|---|---|
| 6,123,554 | A * | 9/2000 | Ortega | H01R 13/514 439/701 |
| 6,356,450 | B1 * | 3/2002 | Andreasen | H05K 7/1428 200/303 |
| 6,375,517 | B1 * | 4/2002 | Okabe | H01R 13/514 439/594 |
| 6,592,381 | B2 * | 7/2003 | Cohen | H01R 12/716 439/65 |

(Continued)

FOREIGN PATENT DOCUMENTS

| | | |
|---|---|---|
| EP | 1 451 902 B1 | 5/2005 |
| WO | 2009 083460 A1 | 7/2009 |

OTHER PUBLICATIONS

Drawing No. C-6469668, Header Assembly, Right Angle, 4 Pair, Latching, HMZd, Rev. A, Feb. 25, 2011, 1pg, Tyco Electronics.

(Continued)

*Primary Examiner* — Abdullah Riyami
*Assistant Examiner* — Nader J Alhawamdeh

(57) ABSTRACT

A header assembly includes a header housing having a cavity configured to receive a receptacle connector therein. The header housing has at least one cartridge latch in the cavity. A signal header cartridge is received in the cavity and locked in the header housing by the at least one cartridge latch. The signal header cartridge has a plurality of signal contacts extending between mating portions and mounting portions that extend from the signal header cartridge. A power header cartridge is received in the cavity and locked in the header housing by the at least one cartridge latch. The power header cartridge has a plurality of power contacts extending between mating portions and mounting portions that extend from the power header cartridge.

23 Claims, 7 Drawing Sheets

(56) References Cited

U.S. PATENT DOCUMENTS

| | | | | |
|---|---|---|---|---|
| 7,195,519 | B1 | 3/2007 | McAlonis et al. | |
| 7,229,318 | B2 * | 6/2007 | Winings | H01R 29/00 439/607.06 |
| 7,507,118 | B2 * | 3/2009 | Azuma | H01R 13/5221 439/274 |
| 7,566,247 | B2 * | 7/2009 | Rothermel | H01R 23/688 439/108 |
| 8,043,127 | B2 * | 10/2011 | Bailey | H01R 13/514 439/701 |
| 8,079,882 | B2 * | 12/2011 | Bailey et al. | 439/717 |
| 8,529,300 | B2 * | 9/2013 | Ritter | H01R 13/514 439/701 |
| 8,771,016 | B2 * | 7/2014 | Atkinson | H01R 13/6474 439/607.07 |
| 2002/0098724 | A1 * | 7/2002 | Cohen | H01R 13/514 439/80 |
| 2003/0119379 | A1 * | 6/2003 | Avery | H01R 13/518 439/701 |
| 2004/0171305 | A1 * | 9/2004 | McGowan | H01R 13/502 439/607.06 |
| 2004/0185716 | A1 * | 9/2004 | Kimura | H01R 12/7005 439/701 |
| 2004/0224559 | A1 * | 11/2004 | Nelson | H01R 13/514 439/607.05 |
| 2006/0046526 | A1 * | 3/2006 | Minich | H01R 13/443 439/65 |
| 2007/0004287 | A1 * | 1/2007 | Marshall | H01R 13/516 439/701 |
| 2007/0099455 | A1 * | 5/2007 | Rothermel | H01R 12/585 439/108 |
| 2008/0045079 | A1 * | 2/2008 | Minich | H01R 12/727 439/544 |
| 2010/0136844 | A1 | 6/2010 | Pan et al. | |
| 2010/0178779 | A1 * | 7/2010 | Davis | H01R 12/724 439/65 |
| 2010/0221959 | A1 | 9/2010 | Pan | |
| 2010/0240233 | A1 * | 9/2010 | Johnescu | H01R 13/514 439/108 |
| 2011/0104953 | A1 * | 5/2011 | Dodds | H01R 12/724 439/660 |
| 2011/0207342 | A1 * | 8/2011 | Davis | H01R 12/724 439/65 |
| 2011/0294325 | A1 * | 12/2011 | McAlonis | H01R 12/722 439/198 |
| 2011/0294337 | A1 * | 12/2011 | McAlonis | H01R 12/722 439/378 |
| 2012/0052695 | A1 * | 3/2012 | Jeon | H05K 1/116 439/55 |
| 2012/0302108 | A1 * | 11/2012 | Raistrick | H01R 12/724 439/842 |
| 2013/0149901 | A1 | 6/2013 | Lee et al. | |
| 2013/0273756 | A1 * | 10/2013 | Stoner | H01R 13/658 439/108 |

OTHER PUBLICATIONS

International Search Report, International Application No. PCT/US2015/010549, International Filing Date, Jan. 8, 2015.

* cited by examiner

HEADER ASSEMBLY HAVING POWER AND SIGNAL CARTRIDGES

BACKGROUND OF THE INVENTION

The subject matter herein relates generally to header assemblies having power and signal cartridges.

Automotive connector systems utilize header connectors to convey both power and data signal. Existing header connector designs utilize stamped blades with assembly stations to stitch and bend the blades in an assembly operation. As the number of blades and the numbers or types of blades increases, the capital investment increases and the assembly rate decreases. Another problem with existing automotive header designs is that using compliant pins is very challenging. For example, the variability of the assembly, such as the variability in the true position of the compliant pins for mounting to a circuit board, causes problems in mounting the header connector to the circuit board.

A need remains for a header connector having reduced manufacturing complexity and cost of assembly with an increase in the quality of header connector.

BRIEF DESCRIPTION OF THE INVENTION

In one embodiment, a header assembly is provided that includes a header housing having a cavity configured to receive a receptacle connector therein. The header housing has at least one cartridge latch in the chamber. A signal header cartridge is received in the cavity and locked in the header housing by the at least one cartridge latch. The signal header cartridge has a plurality of signal contacts extending between mating portions and mounting portions. The mating portions extend from the signal header cartridge into the cavity and defining separable mating interfaces. A power header cartridge is received in the cavity and locked in the header housing by the at least one cartridge latch. The power header cartridge has a plurality of power contacts extending between mating portions and mounting portions. The mating portions extend from the power header cartridge into the cavity and defining separable mating interfaces.

In another embodiment, a header assembly is provided including a first header housing and a second header housing. The first header housing has a first cavity configured to receive a receptacle connector therein. The first header housing has a first housing lock along an exterior thereof. The first header housing receives a plurality of header cartridges in the first cavity each having a plurality of header contacts extending between mating portions and mounting portions. The mating portions define separable mating interfaces for mating with the corresponding receptacle connector and the mounting portions extend from the corresponding header cartridge, such as for mounting to a circuit board. The second header housing has a second cavity configured to receive a receptacle connector therein. The second header housing has a second housing lock along an exterior thereof. The second header housing receives a plurality of header cartridges in the first cavity each having a plurality of header contacts extending between mating portions and mounting portions. The mating portions define separable mating interfaces for mating with the corresponding receptacle connector and the mounting portions extend from the corresponding header cartridge, such as for mounting to the circuit board. The first housing lock interacts with the second housing lock to lock the first and second header housings together for mounting to the circuit board as a unit.

In a further embodiment, a header assembly is provided including a header housing having a cavity configured to receive a receptacle connector in a front of the cavity. The cavity has a power cartridge slot in a rear of the cavity and a signal cartridge slot in the rear of the cavity. A signal header cartridge is received in the signal cartridge slot. The signal header cartridge has a plurality of signal contacts extending between mating portions and mounting portions. The mating portions extend from the signal header cartridge into the cavity and define separable mating interfaces for mating with the receptacle connector. The header assembly includes a first power header cartridge having a plurality of power contacts extend between mating portions and mounting portions. The mating portions are configured to extend from the power header cartridge into the cavity. The header assembly includes a second power header cartridge having a plurality of power contacts extending between mating portions and mounting portions. The mating portions are configured to extend from the power header cartridge into the cavity. The power contacts of the second power header cartridge having a different cumulative current carrying capacity than the power contacts of the first power header cartridge. The power cartridge slot selectively receives either the first power header cartridge or the second power header cartridge to change the current carrying capacity of the header assembly.

DETAILED DESCRIPTION OF THE INVENTION

Embodiments described herein include a connector system having right angle, board-mounted header connectors. The header connectors have both a power interface and a signal interface for transmitting power and data signals, respectively. It should be noted that although the embodiments described herein are described with respect to right angle connectors, the embodiments may be used with any suitable connectors.

Embodiments described herein have features that allow for a modular design of the header connectors. The header connectors include cartridges that may be interchanged within the header connector to change the interface of the header connector. The cartridges may be dedicated signal cartridges and dedicated power cartridges. The current carrying capacity of the header connector may be changed by swapping out the power cartridge for a power cartridge having a different current carrying capacity.

Embodiments described herein have features for retaining the cartridges in the header housing. Embodiments described herein have features that guide the cartridges into position within the header housing. Embodiments described herein provide features that allow multiple header housings to be linked or joined together as a unit for mounting to the circuit board as a unit.

Figure 1:
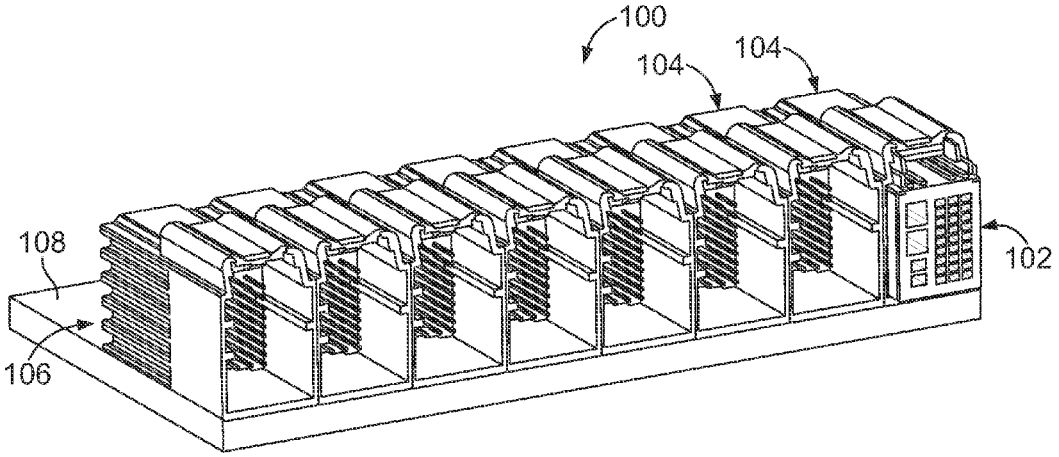
FIG. 1 illustrates a connector system formed in accordance with an exemplary embodiment, showing a receptacle connector coupled to a corresponding header connector of a header assembly.

FIG. 1 illustrates a connector system 100 formed in accordance with an exemplary embodiment, showing a receptacle connector 102 coupled to a corresponding header connector 104 of a header assembly 106. The header assembly 106 may include any number of header connectors 104. Each header connector 104 is configured to be mated with a corresponding receptacle connector 102, although only one receptacle connector 102 is illustrated in FIG. 1. The receptacle connector 102 may be a cable connector with a plurality of cables (only one shown in FIG. 1) extending therefrom terminated to corresponding receptacle contacts (not shown). Alternatively, the receptacle connector 102 may be terminated to a circuit board (not shown), such as by terminating pins or tails of the receptacle contacts to the circuit board. The header assembly 106 is mounted to a circuit board 108, however may alternatively be a cable connector terminated to ends of cables. In an exemplary embodiment, each header connector 104 is terminated to the circuit board 108, such as by press-fitting header contacts 110 of the header assembly 106 into corresponding plated vias (not shown) in the circuit board 108 or by soldering to the circuit board 108. Optionally, the header connectors 104 may be coupled together and then terminated to the circuit board 108 together as a unit. Alternatively, the header connectors 104 may be individually terminated to the circuit board 108.

Figure 2:
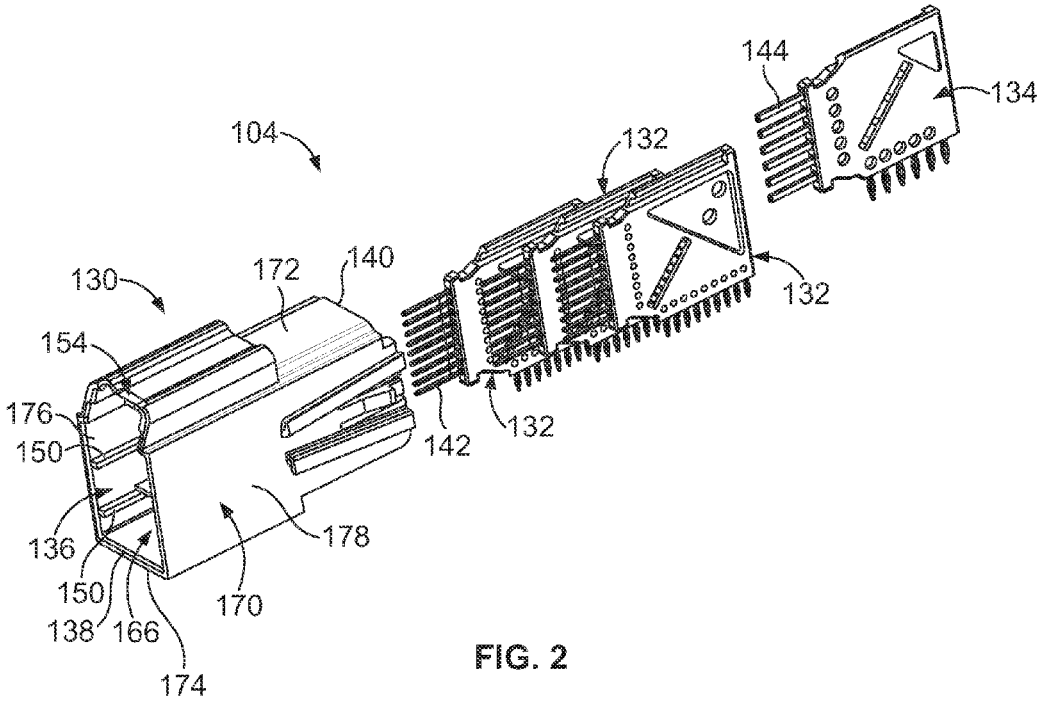
FIG. 2 is an exploded front view of the header connector formed in accordance with an exemplary embodiment.
Figure 3:
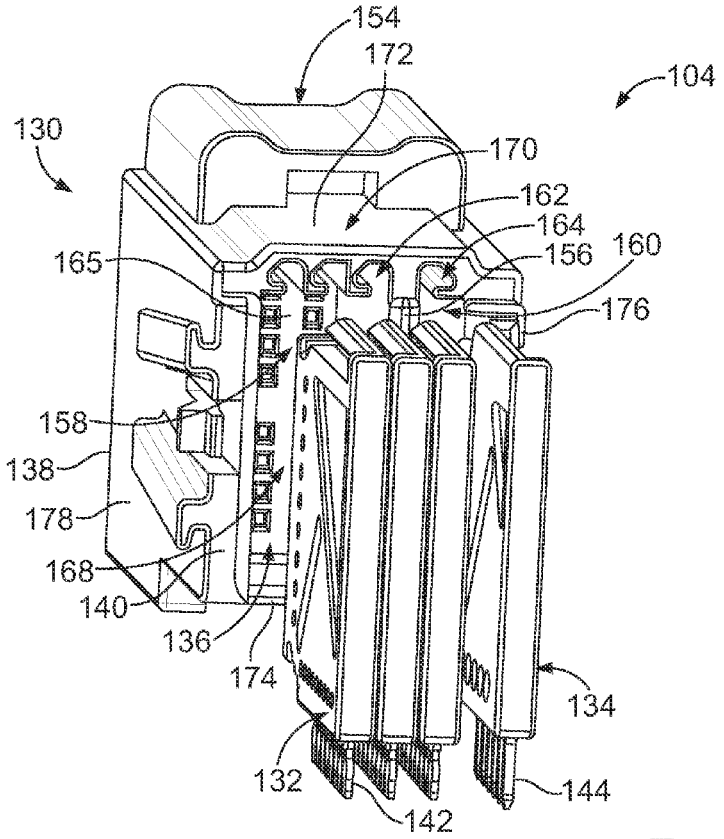
FIG. 3 is an exploded rear view of the header connector.

FIG. 2 is an exploded front view of the header connector 104 formed in accordance with an exemplary embodiment. FIG. 3 is an exploded rear view of the header connector 104. The header connector 104 includes a header housing 130 and a plurality of header cartridges 132, 134. The header cartridges 132, 134 hold a plurality of the header contacts 110, which are more specifically identified as header signal contacts 142 and header power contacts 144 for transmitting data signals and power, respectively, with the receptacle connector 102 (shown in FIG. 1). Other types of header contacts 110 may be used in addition to the signal and power contacts 142, 144, such as ground contacts (not shown). Optionally, each of the power contacts 144 may be held together in a common header cartridge 134, also referred to as a power header cartridge 134. The signal contacts 142 may be held together in dedicated signal header cartridges, which may be referred to hereinafter as signal header cartridges 132. Alternatively, any of the header cartridges 132 and/or 134 may have both signal and power contacts 142, 144, or other types of contacts.

The header housing 130 has a cavity 136 open at a front 138 of the header housing 130 to receive the receptacle connector 102. The cavity 136 is open at a rear 140 of the header housing 130 for receiving the header cartridges 132, 134. Any number of signal header cartridges 132 may be loaded into the header housing 130 depending on the particular application. Any number of power header cartridges 134 may be loaded into the header housing 130 depending on the particular application, although the embodiments illustrated herein show a single power header cartridge 134. Having the header power contacts 144 and the header signal contacts 142 held by a common header housing 130 allows both the header power contacts 144 and the header signal contacts 142 to be mated during a common mating process to the receptacle connector 102. Having the header power contacts 144 and the header signal contacts 142 held by a common header housing 130 allows the header power contacts 144 and the header signal contacts 142 to be mounted to the circuit board 108 (shown in FIG. 1) at the same time during a common assembly step.

In an exemplary embodiment, the header housing 130 includes guide features 150 that are used to guide alignment and mating with the receptacle connector 102. In the illustrated embodiment, the guide features 150 are defined by ribs or protrusions that extend into the cavity 136 near or at the front 138. The number of guide features 150 and/or location of guide features 150 may provide keying features for keyed mating with the corresponding receptacle connector 102. For example, only one type of receptacle connector 102 may be received in the cavity 136 based on the positions of the guide features 150. The positions of the guide features 150 may be different, such as when a different number of power contacts 144 and/or signal contacts 142 are used, which corresponds to a different type of receptacle connector 102 that needs to be mated with the particular header connector 104.

The header housing 130 includes a receptacle latch 154 at the front 138 that is used for securing the receptacle connector 102 in the cavity 136. The receptacle latch 154 may be deflectable and releasable to allow the receptacle connector 102 to be released from the cavity 136. Alternatively, the receptacle connector 102 may include a deflectable latch, or other type of latch, to secure the receptacle connector 102 to the header connector 104. Any type of latch, in various locations, may be used to retain the receptacle connector 102 in the header housing 130.

In an exemplary embodiment, the header housing 130 includes a separating wall 156 (shown in FIG. 3) in the cavity 136, such as adjacent the rear 140. The separating wall 156 divides the cavity 136 into one or more signal cartridge slots 158 and one or more power cartridge slots 160. The signal cartridge slot(s) 158 receive corresponding signal header cartridges 132. The power cartridge slot(s) 160 receive corresponding power header cartridges 134. In an exemplary embodiment, the header housing 130 includes one or more guide channels 162 in the signal cartridge slot(s) 158 and one or more guide channels 164 in the power cartridge slots 160. The guide channels 162 are provided along a top of the cavity 136 and receive corresponding guide features of the signal header cartridges 132. The guide channels 164 are provided along a top of the cavity 136 and receive corresponding guide features of the power header cartridges 134. The guide channels 162, 164 position the header cartridges 132, 134 relative to one another. The guide channels 162, 164 may hold side-to-side positions of the header cartridges 132, 134. Optionally, the guide channels 162, 164 may have a dovetail shape.

The header housing 130 includes a mid-wall 165 (better shown in FIG. 4) within the cavity 136. The mid-wall 165 extends from side wall to side wall and may be parallel to the front 138 and rear 140. The mid-wall 165 is positioned between the front 138 and the rear 140. The mid-wall 165 may be approximately centered between the front 138 and the rear 140. The mid-wall 165 divides the cavity 136 into a front cavity 166 (shown in FIG. 2 and FIG. 4) and a rear cavity 168 (shown in FIG. 3). The receptacle connector 102 is configured to be received in the front cavity 166. The header cartridges 132, 134 are configured to be received in the rear cavity 168.

The header housing 130 has a plurality of walls 170 defining an exterior of the header housing 130 and interior surfaces of portions of the header housing 130, such as the cavity 136. In an exemplary embodiment, the header housing 130 includes walls 170 that define a top 172, a bottom 174, a first side 176, and a second side 178 of the header housing 130. Optionally, the header housing 130 may be generally rectangular in shape, however other shapes are possible in alternative embodiments. The walls 170 may define a generally rectangular cavity 136 that receives the receptacle connector 102.

The separating wall 156 is oriented generally parallel to and positioned between the first and second sides 176, 178. The power cartridge slot 160 is defined between the separating wall 156 and the first side 176. The signal cartridge slot 158 is defined between the separating wall 156 and the second side 178. When the power header cartridge 134 is loaded in the power cartridge slot 160, the power header cartridge 134 may engage the separating wall 156 and/or the first side 176, such as to hold the power header cartridge 134. The guide channel 164 may secure the power header cartridge 134.

Figure 4:
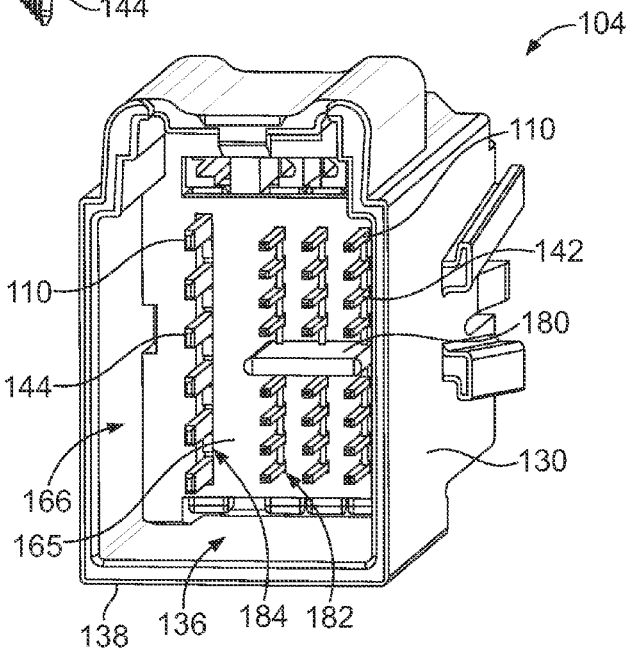
FIG. 4 is a front perspective view of the header connector in an assembled state.

FIG. 4 is a front perspective view of the header connector 104 in an assembled state. FIG. 4 shows the signal and power contacts 142, 144 extending into the front cavity 166. In an exemplary embodiment, the header housing 130 may include a platform 180 extending forward of the mid-wall 165 into the front cavity 166. The platform 180 may be used to position the receptacle connector 102 within the cavity 136, such as to align corresponding receptacles in the receptacle connector 102 with the header contacts 110. The platform 180 may extend beyond the forward ends of the header contacts 110 to ensure that the receptacle connector 102 is aligned within the cavity 136 prior to mating with the header contacts 110. Damage to the header contacts 110 may be avoided by such arrangement.

The mid-wall 165 includes a plurality of signal contact openings 182 therethrough. The signal contacts 142 pass through corresponding signal contact openings 182 into the front cavity 166. The signal contact openings 182 may be used to position the signal contacts 142, such as by supporting the signal contacts 142 at predetermined locations relative to one another and relative to the front cavity 166 for mating with the receptacle connector 102.

The mid-wall 165 includes a power contact opening 184 therethrough that receives the power contacts 144. Optionally, the power contact opening 184 is an elongated slot that receives each of the power contacts 144. The elongated power contact opening 184 is able to receive the power contacts 144 irrespective of the location (e.g. vertical position) of the power contacts 144. The power contact opening 184 is configured to receive each of the corresponding power contacts 144 irrespective of the size and position of the power contacts 144. As such, when different types of power header cartridges 134 are used, each having a different arrangement (e.g. number size, position) of power contacts 144, the power contact opening 184 is able to accommodate any of the different types of power header cartridges 134. As will be further described below, the same header housing 130 is able to accommodate different types of power header cartridges 134, such as low power cartridges, medium power cartridges, or high power cartridges having relative low, medium, and high current carrying capabilities, respectively.

Figure 5:
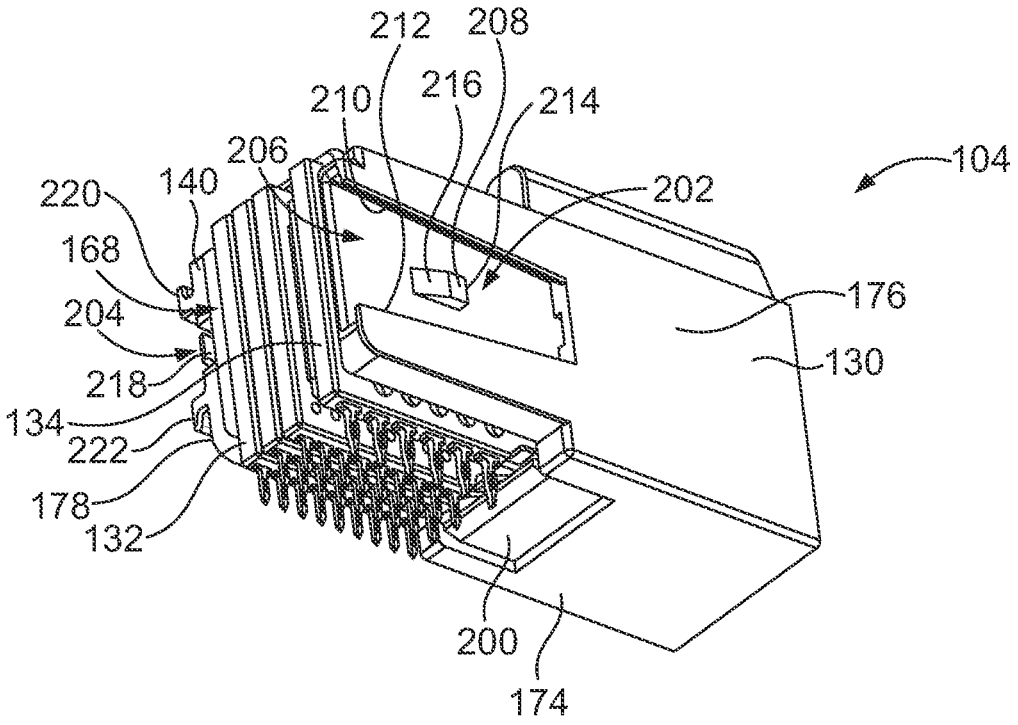
FIGS. 5 and 6 are rear perspective views of the header connector in an assembled state with header cartridges loaded into a header housing.
Figure 6:
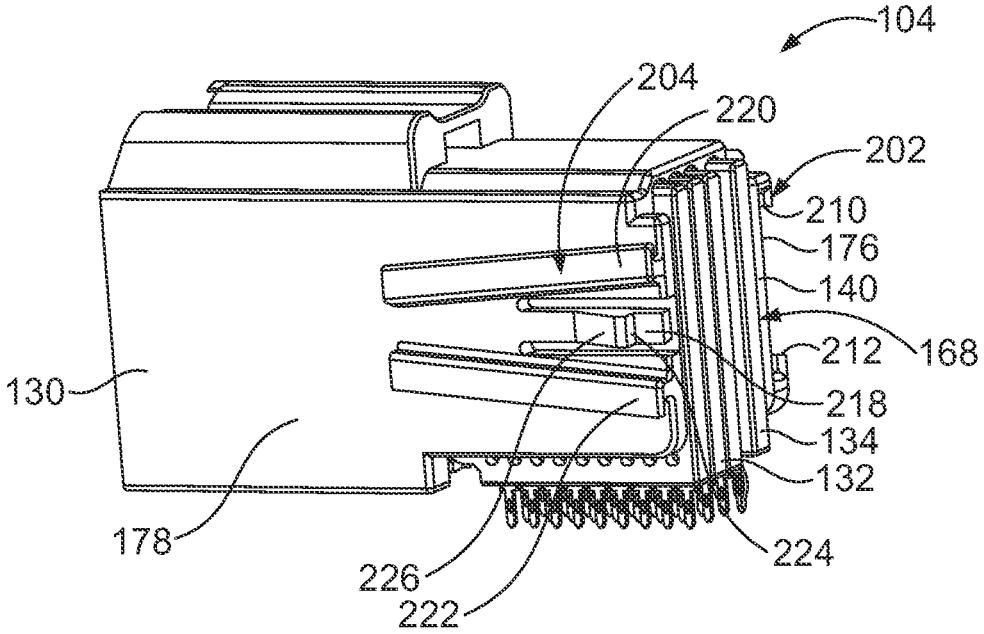

FIGS. 5 and 6 are rear perspective views of the header connector 104 in an assembled state with the header cartridges 132, 134 loaded into the header housing 130. The header housing 130 includes one or more cartridge latches 200 (shown in FIG. 5) that are used to lock the header cartridges 132, 134 in the cavity 136. The cartridge latch(s) 200 hold front-to-back positions of the signal header cartridge 132 and power header cartridge 134. Optionally, the cartridge latch(s) 200 may be provided in the rear cavity 168 along the bottom 174. The cartridge latch(s) 200 may be deflectable to release the header cartridges 132, 134 from the header housing 130. A single cartridge latch 200 is illustrated in FIG. 5, however in alternative embodiments multiple cartridge latches 200 may be used. For example, a first cartridge latch may engage one or more of the signal header cartridges 132 and a second cartridge latch may engage the power header cartridge 134.

The header connector 104 includes housing locks 202, 204 (shown in FIGS. 5 and 6, respectively) along the first and second sides 176, 178 of the header housing 130. The housing locks 202, 204 are used to lock the header housing 130 to an adjacent header connector 104 within the header assembly 106 (shown in FIG. 1). The housing locks 202, 204 allow the header connectors 104 to be stacked and secured together such that the header assembly 106 may be coupled to the circuit board 108 (shown in FIG. 1) as a unit.

The housing lock 202 is configured to interact with a housing lock 204 of an adjacent header connector 104 to lock the header connectors 104 together. The housing lock 202 includes a pocket 206 formed in the side 176 and a latch 208 in the pocket 206. The pocket 206 includes first and second channels or rails 210, 212 on opposite sides of the pocket 206. Optionally, the rails 210, 212 may be angled transverse to one another. For example, the rails 210, 212 may be angled inward toward one another to decrease the size of the pocket 206. In the illustrated embodiment, the pocket 206 is open at the rear 140. The pocket 206 is wider at the rear 140 and narrower at the front of the pocket 206. The latch 208 includes a catch surface 214 that is front facing. The latch 208 may have a ramped surface 216 rearward of the catch surface 214. Optionally, the latch 208 may be deflectable.

The housing lock 204 is configured to interact with a housing lock 202 of an adjacent header connector 104 to lock the header connectors 104 together. The housing lock 204 includes a latch 218 configured to latchably couple to the latch 208. In the illustrated embodiment, the latch 218 is deflectable. The housing lock 204 includes first and second tabs 220, 222 that extend outward from the side 178. Optionally, the tabs 220, 222 may be angled transverse to one another at a complementary angle to the rails 210, 212. The tabs 220, 222 are configured to be received in corresponding rails 210, 212.

During assembly of the header assembly 106, the housing lock 204 is loaded into the housing lock 202 of an adjacent header connector 104 from the rear of the housing lock 202. The header connector 104 is thus forward loaded or forward locked in a forward direction. The tabs 220, 222 are loaded into the pocket 206 of the corresponding housing lock 202. The tabs 220, 222 engage the rails 210, 212 of the corresponding housing lock 202 to align the header housings 130. The latch 218 engages the latch 208 of the corresponding housing lock 202 to lock the header connectors 104 together. The latch 218 includes a catch surface 224. The catch surface 224 is configured to engage the catch surface 214 of the adjacent header connector 104 to lock the header connectors 104 together. The latch 218 may have a ramped surface 226 leading to the catch surface 224. The ramped surface 226 may ride along the ramped surface 216 to deflect the latch 218 during locking of the header connectors 104.

Figure 7:
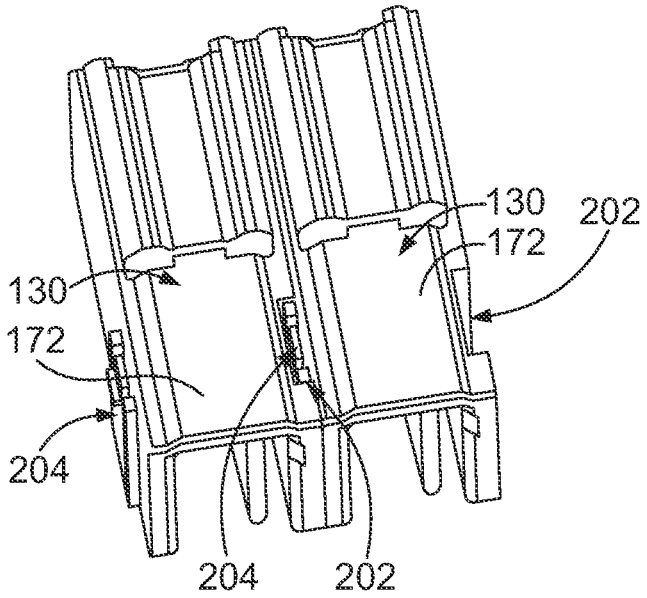
FIG. 7 illustrates first and second header housings coupled together.

FIG. 7 illustrates first and second header housings 130 coupled together. The header housings 130 illustrated in FIG. 7 includes the housing locks 202, 204 to secure the header housings 130 together. The housing locks 202, 204 in the embodiment shown in FIG. 7 are oriented vertically, as opposed to horizontally (as shown in FIGS. 5 and 6). The housing lock 202 is open at the top 172. During mating, the housing lock 204 is loaded into the pocket 206 (better shown in FIG. 5) of the housing lock 202 of the adjacent header connector 104 from the top of the housing lock 202. The header connector 104 is thus top loaded in a downward direction.

Figure 8:
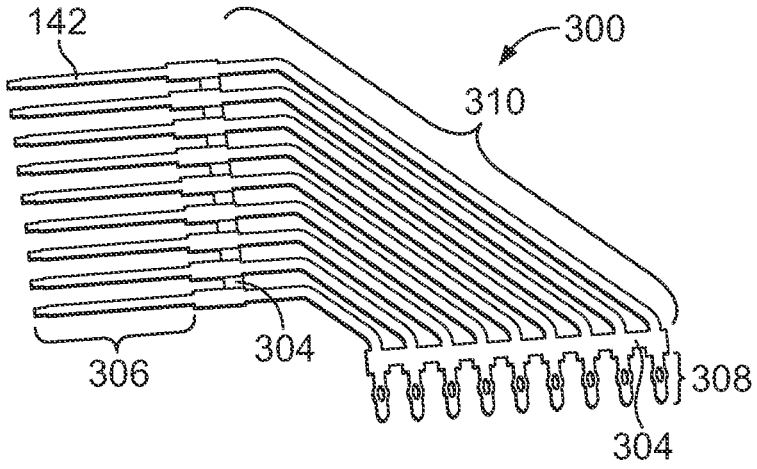
FIG. 8 illustrates a lead frame for a signal header cartridge.
Figure 9:
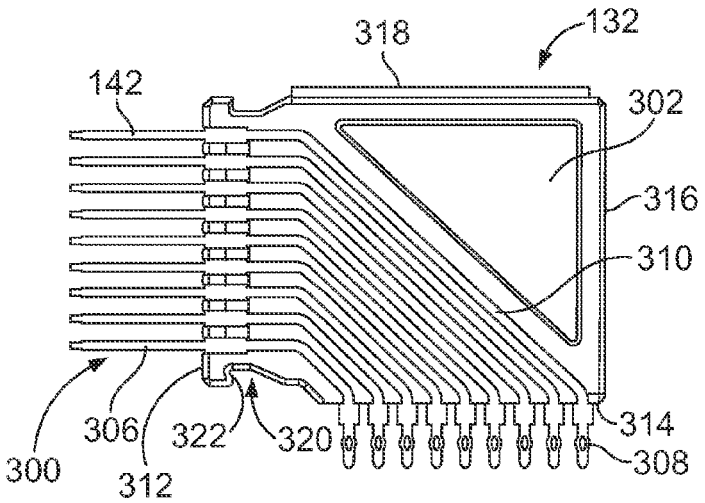
FIG. 9 is a side view of a signal header cartridge formed in accordance with an exemplary embodiment.

FIG. 8 illustrates a lead frame 300 for the signal header cartridge 132 (shown in FIG. 9). FIG. 9 is a side view of the signal header cartridge 132. The signal header cartridge 132 includes a dielectric frame 302 holding the lead frame 300. The lead frame 300 includes a plurality of the header signal contacts 142, which are initially held together by carrier segments 304 that are later removed to electrically separate the header signal contacts 142. Optionally, a ground shield (not shown) may be coupled to one or both sides of the dielectric frame 302 to provide electrical shielding for the header signal contacts 142.

The header signal contacts 142 have mating portions 306 and mounting portions 308 with transition portions 310 extending between the mating portions 306 and the mounting portions 308. The transition portions 310 are the portions of the header signal contacts 142 that are encased in, loaded in, or otherwise surrounded by the dielectric frame 302. The mating portions 306 and mounting portions 308 extend from the dielectric frame 302. In an exemplary embodiment, the header signal contacts 142 are right angle contacts. The right angle contacts have the mating portions 306 and the mounting portions 308 orientated generally perpendicular with respect to one another. The mating portions 306 extend forward from a mating edge 312 of the dielectric frame 302 and define separable mating interfaces. The mounting portions 308 extend from a mounting edge 314 of the dielectric frame 302. In the illustrated embodiment, the mating edge 312 defines a front edge of the dielectric frame 302 (may be referred to hereinafter as front edge 312) while the mounting edge 314 defines a bottom edge of the dielectric frame 302 (may be referred to hereinafter as bottom edge 314). The mating edge 312 and the mounting edge 314 may be orientated generally perpendicular with respect to one another. The mounting portions 308 may be compliant pins (and may be referred to hereinafter as compliant pins 308) extending from the bottom edge 314 configured to be press fit in corresponding plated vias in the circuit board 108 (shown in FIG. 1). In alternative embodiments, the mounting portions may be terminated to wires or cables, such as by soldering, crimping or otherwise terminating the wires or cables to the mounting portions.

The dielectric frame 302 includes a rear edge 316 opposite the mating edge 312 and a top edge 318 opposite the mounting edge 314. In an exemplary embodiment, the dielectric frame 302 generally defines a rectangular structure bounded by the edges 312, 314, 316, 318. The edges 312, 314, 316, 318 may include bump outs, notch outs, protrusions, tabs, lugs, projections or other features that create non planar edges, however the overall structure may be generally rectangular. Other shapes are possible in alternative embodiments. The mating edge 312 and the mounting edge 314 generally meet at an intersection area, such as a corner, and extend radially out therefrom. The header signal contacts 142 are stacked outward from the corner. In an exemplary embodiment, the dielectric frame 302 includes a pocket 320 in the corner at or near the the intersection area of the mating edge 312 and the mounting edge 314. The pocket 320 includes a catch surface 322. In an exemplary embodiment, the pocket 320 receives the cartridge latch 200 (shown in FIG. 5) to lock the header cartridge 132 in the header housing 130.

The dielectric frame 302 holds the header signal contacts 142. In an exemplary embodiment, the dielectric frame 302 is manufactured using an over-molding process. During the over-molding process, the lead frame 300 is encased in a dielectric material, which forms the dielectric frame 302. Prior to over-molding, the lead frame 300 may be stabilized by a carrier strip (not shown) which is removed and discarded with the carrier segments 304 after the over-molding process that creates the dielectric frame 302. The dielectric frame 302 may be manufactured by other processes in alternative embodiments. The lead frame 300 may be loaded into the dielectric frame 302 through a side of the dielectric frame 302 rather than being overmolded in alternative embodiments.

The lead frame 300 may include any number of header signal contacts 142. Optionally, rather than being all signal contacts, the header contacts may be ground contacts, power contacts, sense contacts or other types of contacts. Optionally, adjacent signal contacts 142 may function as differential pairs, and each differential pair may be separated by a ground contact. Optionally, the contacts may have different widths along the entire lengths, or portions of the lengths, thereof, such as to control spacing or gaps between the contacts, to achieve a target impedance, to increase the current carrying capability of the contacts, and the like.

Figure 10:
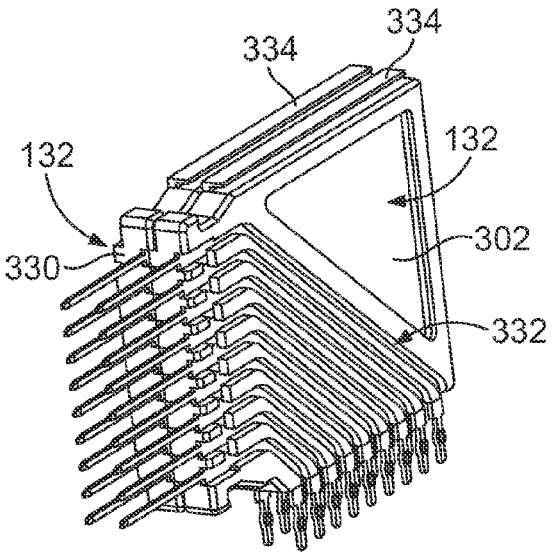
FIG. 10 illustrates a pair of signal header cartridges stacked together.
Figure 11:
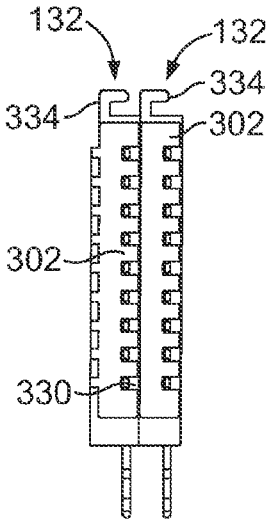
FIG. 11 is a front view of the pair of signal header cartridges.

FIG. 10 illustrates a pair of signal header cartridges 132 stacked together. FIG. 11 is a front view of the pair of signal header cartridges 132. Any number of signal header cartridges 132 may be stacked together and loaded into the header housing 130 (shown in FIG. 2). The signal header cartridges 132 are arranged side-by-side. Optionally, the signal header cartridges 132 may directly engage one another. The signal header cartridges 132 may include ribs 330 extending from one or both sides. The ribs 330 may be received in corresponding slots 332 in the adjacent signal header cartridge 132. The ribs 330 may be held in the slots by an interference fit. The ribs 330 may be used to secure the signal header cartridges 132 together.

In an exemplary embodiment, the dielectric frame 302 includes a rail 334 along the top edge 318 of the dielectric frame 302. The rails 334 are received in corresponding guide channels 162 (shown in FIG. 3) to position the signal header cartridges 132 relative to one another and relative to the header housing 130 (shown in FIG. 3). The rails 334 may have a dovetail shape.

Figure 12:
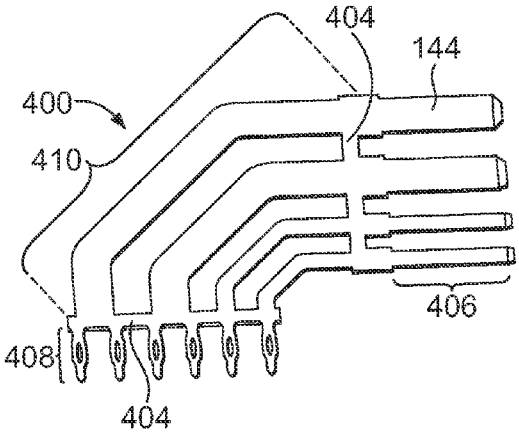
FIG. 12 illustrates a lead frame for a power header cartridge.
Figure 13:
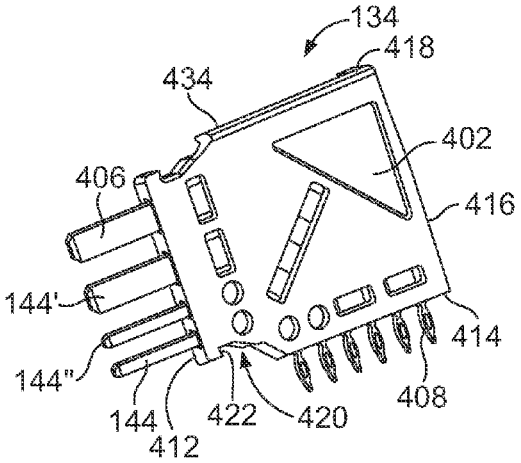
FIG. 13 is a perspective view of a power header cartridge formed in accordance with an exemplary embodiment.

FIG. 12 illustrates a lead frame 400 for the power header cartridge 134 (shown in FIG. 13). FIG. 13 is a perspective view of the power header cartridge 134. The lead frame 400 may be similar to the lead frame 300 (shown in FIG. 8) and the power header cartridge 134 may be similar to the signal header cartridge 132 (shown in FIG. 9).

The power header cartridge 134 includes a dielectric frame 402 holding the lead frame 400. The lead frame 400 includes a plurality of the header power contacts 144, which are held together by carrier segments 404. The carrier segments 404 may or may not be removed depending on the particular application.

The header power contacts 144 have mating portions 406 and mounting portions 408 with transition portions 410 extending between the mating portions 406 and the mounting portions 408. The transition portions 410 are the portions of the header power contacts 144 that are encased in, loaded in, or otherwise surrounded by the dielectric frame 402. The mating portions 406 and mounting portions 408 extend from the dielectric frame 402. In an exemplary embodiment, the header power contacts 144 are right angle contacts. The right angle contacts have the mating portions 406 and the mounting portions 408 orientated generally perpendicular with respect to one another. The mating portions 406 extend forward from a mating edge 412 of the dielectric frame 402 and define separable mating interfaces. The mounting portions 408 extend from a mounting edge 414 of the dielectric frame 402. In the illustrated embodiment, the mating edge 412 defines a front edge of the dielectric frame 402 (may be referred to hereinafter as front edge 412) while the mounting edge 414 defines a bottom edge of the dielectric frame 402 (may be referred to herein after as bottom edge 414). The mating edge 412 and the mounting edge 414 may be orientated generally perpendicular with respect to one another. The dielectric frame 402 includes a rear edge 416 opposite the mating edge 412 and a top edge 418 opposite the mounting edge 414. The mounting portions 408 may be compliant pins (and may be referred to hereinafter as compliant pins 408) extending from the bottom edge 414 configured to be press fit in corresponding plated vias in the circuit board 108 (shown in FIG. 1). In alternative embodiments, the mounting portions may be terminated to wires or cables, such as by soldering, crimping or otherwise terminating the wires or cables to the mounting portions.

The mating edge 412 and the mounting edge 414 generally meet at an intersection area, such as a corner, and extend radially out therefrom. The header power contacts 144 are stacked outward from the corner. In an exemplary embodiment, the dielectric frame 402 includes a pocket 420 in the corner at or near the intersection area of the mating edge 412 and the mounting edge 414. The pocket 420 includes a catch surface 422. In an exemplary embodiment, the pocket 420 receives the cartridge latch 200 (shown in FIG. 5) to position and/or lock the header cartridge 134 in the header housing 130 (shown in FIG. 5).

In an exemplary embodiment, the dielectric frame 402 includes a rail 434 along the top edge 418 of the dielectric frame 402. The rails 434 are received in corresponding guide channels 162 (shown in FIG. 4) to position the signal header cartridges 132 relative to one another and relative to the header housing 130 (shown in FIG. 3). The rails 434 may have a dovetail shape.

The lead frame 400 may include any number of header power contacts 144. The header power contacts 144 may all have equal widths, or alternatively may have different widths. The widths of the header power contacts 144 may control the current carrying capacity of such header power contacts 144. For example, wider header power contacts 144 may have a higher current carrying capacity as compared to narrower header power contacts 144. In an exemplary embodiment, different types of power header cartridges 134 may be manufactured rated based on the cumulative current carrying capacity of the header power contacts 144.

Figure 14:
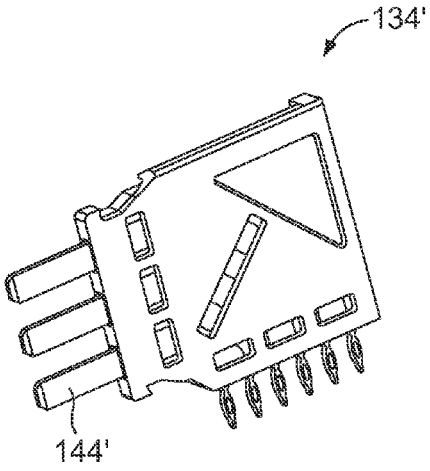
FIG. 14 illustrates a power header cartridge formed in accordance with an exemplary embodiment.
Figure 15:
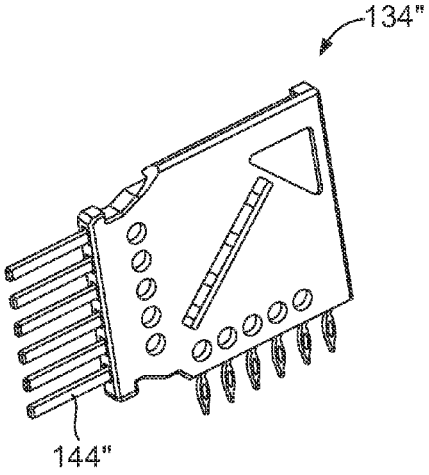
FIG. 15 illustrates a power header cartridge formed in accordance with an exemplary embodiment.

FIG. 14 illustrates a power header cartridge 134' formed in accordance with an exemplary embodiment. FIG. 15 illustrates a power header cartridge 134" formed in accordance with an exemplary embodiment. With additional reference back to FIG. 13, a group of power header cartridges 134, 134', 134" are shown.

Each of the power header cartridges 134, 134', 134" have different current carrying capacities. For example, the power header cartridge 134' (FIG. 14) may have a high current carrying capacity, the power header cartridge 134 (FIG. 13) may have a medium current carrying capacity and the power header cartridge 134 (FIG. 15) may have a low current carrying capacity compared to the other power header cartridges, respectively. For example, the power header cartridges 134, 134', 134" may have different combinations of wide header power contacts 144' and narrow header power contacts 144".

In the illustrated embodiments, the high current power header cartridge 134' (FIG. 14) includes three wide header power contacts 144' and zero narrow header power contacts 144". The medium current power header cartridge 134 (FIG. 13) includes two wide header power contacts 144' and two narrow header power contacts 144". The low current power header cartridge 134" (FIG. 15) includes zero wide header power contacts 144' and six narrow header power contacts 144". Other combinations of wide and narrow header power contacts 144 may be used in other embodiments. Header power contacts 144 having other widths than the two widths illustrated in FIG. 13-15 may be used in other embodiments.

Each of the power header cartridges 134, 134', 134" have an identical, or substantially similar, dielectric frame 402. For example, the edges are all sized and shaped the same such that any of the power header cartridges 134, 134', 134" may be alternately or selectively loaded into the power cartridge slot 160 (shown in FIG. 3). With reference to FIG. 3, it is clear that any of the power header cartridges 134, 134', 134" may be loaded into the power cartridge slot 160. As such, the current carrying capacity of the header connector 104 may be changed by swapping out any power header cartridge 134, 134', 134" for a different type of power header cartridge 134, 134', 134". For example, the power cartridge slot 160 selectively receives either the low power header cartridge 134", the medium power header cartridge 134 or the high power header cartridge 134" to change the current carrying capacity of the header assembly 104. With reference to FIG. 4, the elongated power contact opening 184 is able to receive any combination of the header power contacts 144. For example, in the illustrated embodiment, the header connector 104 is holding the low current power header cartridge 134" (FIG. 15) and includes six narrow header power contacts 144. However, when the medium or high current power header cartridges 134, 134' (FIGS. 13, 14, respectively) are loaded into the header housing 130, the elongated power contact opening 184 accommodates the wide header power contacts 144, irrespective of their size or position.

Figure 16:
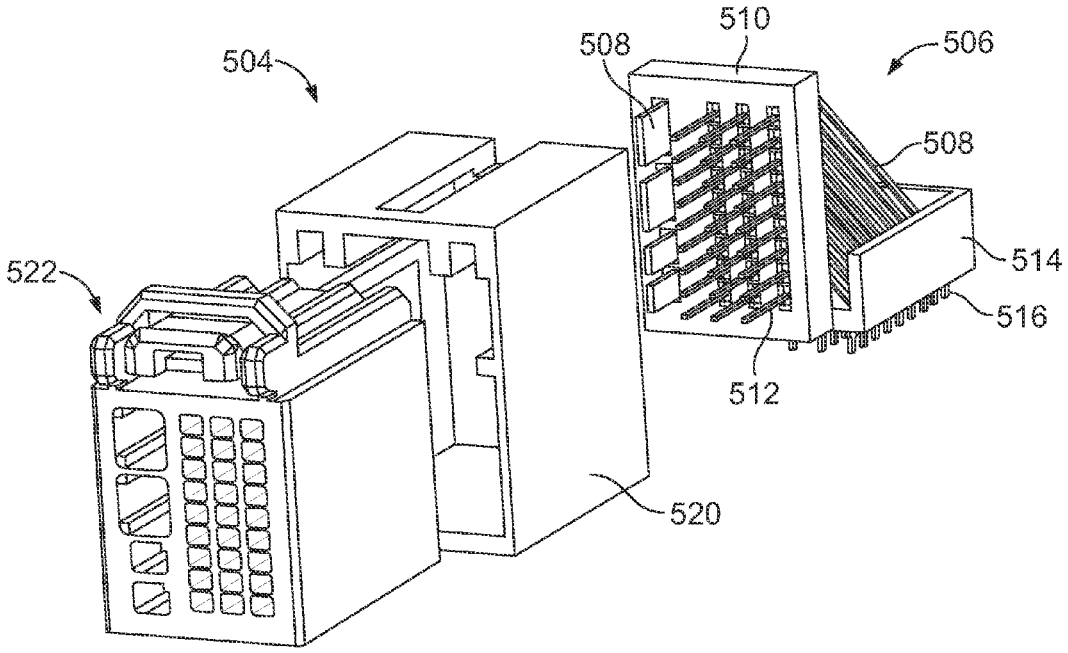
FIG. 16 illustrates a header connector formed in accordance with an exemplary embodiment.

FIG. 16 illustrates a header connector 504 that is similar to the header connector 104. The header connector 504 includes a different type of header cartridge 506 than the header connector 104. The header connector 504 includes an array of header contacts 508. The header connector 504 includes a shroud guide 510 supporting mating ends 512 of the header contacts 508 and a pin guide 514 supporting mounting ends 516 of the header contacts 508. The shroud guide 510 and pin guide 514 may hold both signal and power header contacts. The shroud guide 510 and pin guide 514, together with the header contacts 508 define the header cartridge 506. The header cartridge 506 may be loaded into a header housing 520 for mating with a receptacle connector 522. Optionally, multiple header housings 520 may be joined together using housing locks.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A header assembly comprising:

a header housing having a cavity configured to receive a receptacle connector therein, the header housing having at least one cartridge latch, the at least one cartridge latch is deflectable and releasable;

a signal header cartridge received in the cavity and locked in the header housing by the at least one cartridge latch, the signal header cartridge having a plurality of signal contacts extending between mating portions and mounting portions, the mating portions extending from the signal header cartridge into the cavity and defining separable mating interfaces; and a power header cartridge received in the cavity and locked in the header housing by the at least one cartridge latch, the power header cartridge having a plurality of power contacts extending between mating portions and mounting portions, the mating portions extending from the power header cartridge into the cavity and defining separable mating interfaces.

2. The header assembly of claim 1, wherein the signal header cartridge includes a pocket receiving the at least one cartridge latch and wherein the power header cartridge includes a pocket receiving the at least one cartridge latch.

3. The header assembly of claim 1, wherein the signal header cartridge includes a dielectric frame holding the signal contacts, the dielectric frame having a bottom edge, the mounting portions of the signal contacts extending from the bottom edge, the dielectric frame including a pocket along the bottom edge receiving the at least one cartridge latch, and wherein the power header cartridge includes a dielectric frame holding the power contacts, the dielectric frame having a bottom edge, the mounting portions of the power contacts extending from the bottom edge, the dielectric frame including a pocket along the bottom edge receiving the at least one cartridge latch.

4. The header assembly of claim 3, wherein the mounting portions comprise compliant pins extending from the bottom edge configured to be press fit in corresponding plated vias in a circuit board.

5. The header assembly of claim 1, wherein the at least one cartridge latch comprises the first cartridge latch and a second cartridge latch independent from the first cartridge latch, the first cartridge latch engaging the signal header cartridge, the second cartridge latch engaging the power header cartridge.

6. The header assembly of claim 1, wherein the header housing includes a plurality of guide channels along a top of the cavity, the signal header cartridge comprising a dielectric frame having a rail along a top edge of the dielectric frame, the power header cartridge comprising a dielectric frame having a rail along a top edge of the dielectric frame, the rails being received in corresponding guide channels to position the power header cartridge relative to the signal header cartridge.

7. The header assembly of claim 6, wherein the at least one cartridge latch is provided at a bottom of the header housing opposite the guide channels, the guide channels holding side-to-side positions of the signal header cartridge and power header cartridge, the at least one cartridge latch holding front-to-back positions of the signal header cartridge and power header cartridge.

8. A header assembly comprising:

a first header housing having a first cavity configured to receive a receptacle connector therein, the first header housing having a first housing lock along an exterior thereof, the first header housing receiving a plurality of separate and discrete header cartridges in the first cavity, each header cartridge having a dielectric frame holding a plurality of header contacts extending between mating portions and mounting portions, the mating portions defining separable mating interfaces for mating with the corresponding receptacle connector; and a second header housing having a second cavity configured to receive a receptacle connector therein, the second header housing having a second housing lock along an exterior thereof, the second header housing receiving a plurality of separate and discrete header cartridges in the second cavity, each header cartridge having a dielectric frame holding a plurality of header contacts extending between mating portions and mounting portions, the mating portions defining separable mating interfaces for mating with the corresponding receptacle connector;

wherein the first housing lock interacts with the second housing lock to lock the first and second header housings together as a unit.

9. The header assembly of claim 8, wherein the first housing lock comprises a pocket and a latch in the pocket, the second housing lock comprises tabs extending therefrom and a latch, the tabs being received in the pocket, the latch of the second hosing lock engages the latch of the first housing lock to lock the second header housing to the first header housing.

10. The header assembly of claim 9, wherein the pocket is defined by a first rail and a second rail angled transverse to the first rail, the tabs being angled transverse to each other at complementary angles with respect to the first and second rails.

11. The header assembly of claim 8, wherein the first header housing receives the receptacle connector at a front thereof and the mounting portions are provided at a bottom of the header housing for mounting to a circuit board, the pocket being open at a rear thereof, the second header hosing being coupled to the first header housing in a forward direction.

12. The header assembly of claim 8, wherein the first header housing receives the receptacle connector at a front thereof and the mounting portions are provided at a bottom of the header housing for mounting to a circuit board, the pocket being open at a top thereof, the second header housing being coupled to the first header housing in a downward direction.

13. The header assembly of claim 8 wherein the first header housing includes a front, a rear, a top, a bottom, and opposite first and second sides, the cavity of the first header housing being open at the front for receiving the receptacle connector, the mounting portions of the header contacts extend from the bottom for mounting to a circuit board, the first housing lock being provided along the first side, the second header housing being coupled to the first header housing such that the first and second header housing are stacked side-by-side.

14. The header assembly of claim 13, wherein the first header housing comprises a third housing lock along the second side for coupling the first header housing to a third header housing along the second side.

15. A header assembly comprising:

a header housing having a cavity configured to receive a receptacle connector in a front of the cavity, the cavity having a power cartridge slot in a rear of the cavity and a signal cartridge slot in the rear of the cavity;

a signal header cartridge received in the signal cartridge slot, the signal header cartridge having a plurality of signal contacts extending between mating portions and mounting portions, the mating portions extending from the signal header cartridge into the cavity and defining separable mating interfaces for mating with the receptacle connector;

a first power header cartridge having a plurality of power contacts extending between mating portions and mounting portions, the mating portions configured to extend from the power header cartridge into the cavity; and a second power header cartridge having a plurality of power contacts extending between mating portions and mounting portions, the mating portions configured to extend from the power header cartridge into the cavity, the power contacts of the second power header cartridge having a different cumulative current carrying capacity than the power contacts of the first power header cartridge;

wherein the power cartridge slot selectively receives either the first power header cartridge or the second power header cartridge to change the current carrying capacity of the header assembly.

16. The header assembly of claim 15, wherein at least some of the power contacts of the second power header cartridge are wider than the power contacts of the first power header cartridge to increase the current carrying capacity of the second power header cartridge as compared to the first power header cartridge.

17. The header assembly of claim 15, wherein the first power header cartridge includes a dielectric frame holding the power contacts of the first power header cartridge, the second power header cartridge includes a dielectric frame holding the power contacts of the second power header cartridge, the dielectric frame of the first power header cartridge being sized and shaped substantially the same as the dielectric frame of the second power header cartridge such that the first power header cartridge and second power header cartridge are configured to be alternately loaded into the power cartridge slot.

18. The header assembly of claim 15, wherein the header housing includes a front, a rear, a top, a bottom, and opposed first and second sides, the header housing including a separating wall parallel to and positioned between the first and second sides, the power cartridge slot being defined between the separating wall and the first side, the signal cartridge slot being defined between the separating wall and the second side.

19. The header assembly of claim 18, wherein, when the first power header cartridge is loaded in the power cartridge slot, the first power header cartridge engages the separating wall and the first side, and wherein, when the second power header cartridge is loaded in the power cartridge slot, the second power header cartridge engages the separating wall and the first side.

20. The header assembly of claim 15, wherein the header housing includes a mid-wall dividing the cavity into a front cavity and a rear cavity, the front cavity receiving the receptacle connector, the rear cavity defining the power cartridge slot and signal cartridge slot, the mid-wall includes a plurality of signal contact openings, the signal contacts passing through corresponding signal contact openings into the front cavity, the mid-wall including a power contact opening receiving the power contacts of the first power header cartridge or second power header cartridge depending on which of the first and second power header cartridges is loaded into the power cartridge slot.

21. The header assembly of claim 20, wherein the power contact opening is elongated to receive each of the corresponding power contacts irrespective of the size and position of the power contacts.

22. The header assembly of claim 20, wherein the header housing has at least one cartridge latch, the at least one cartridge latch being deflectable and releasable, the first or second header cartridges being configured to be locked in the header housing by the at least one cartridge latch and being releasable by deflecting the at least one cartridge latch to remove the corresponding first or second header cartridge and replace the first or second header cartridge with the other of the first or second header cartridge to change the current carrying capacity of the header assembly.

23. The header assembly of claim 8, wherein the first header housing has at least one cartridge latch and the second header housing has at least one cartridge latch, the cartridge latches being deflectable and releasable, the header cartridges received in the first and second cavities and locked in the corresponding first and second header housings by the cartridge latches, the header cartridges being released by deflecting the cartridge latches to remove the header cartridges from the corresponding first and second header housings.

* * * * *